US008453823B2

(12) United States Patent
Kern et al.

(10) Patent No.: US 8,453,823 B2
(45) Date of Patent: Jun. 4, 2013

(54) TRANSPORTING APPARATUS FOR WEB PRODUCTS AND RELATED METHODS

(75) Inventors: Peter Kern, St. Peter Port (GB); Reinhard Buri, Donaueschingen/Pfohren (DE); Eberhard Knödler, Bonndorf (DE)

(73) Assignee: Kern International, Inc.

( * ) Notice: Subject to any disclaimer, the term of this patent is extended or adjusted under 35 U.S.C. 154(b) by 293 days.

(21) Appl. No.: 12/231,749

(22) Filed: Sep. 5, 2008

(65) Prior Publication Data

US 2010/0059335 A1 Mar. 11, 2010

(51) Int. Cl.
*B65G 47/26* (2006.01)
*B65B 43/26* (2006.01)

(52) U.S. Cl.
USPC ..... 198/457.03; 198/460.1; 53/569

(58) Field of Classification Search
None
See application file for complete search history.

(56) References Cited

U.S. PATENT DOCUMENTS

| | | | | |
|---|---|---|---|---|
| 24,459 | A | | 6/1859 | Hall |
| 1,911,961 | A | | 5/1933 | Melnick |
| 2,915,863 | A | | 12/1959 | Kummer |
| 3,253,384 | A | | 5/1966 | Huck et al. |
| 3,568,401 | A | | 3/1971 | Bonsch |
| 3,753,836 | A | | 8/1973 | Buckholz |
| 3,872,649 | A | | 3/1975 | Wimmer |
| 4,132,402 | A | | 1/1979 | Morrison et al. |
| 4,228,953 | A | | 10/1980 | Ingram, Jr. et al. |
| 4,360,356 | A | | 11/1982 | Hall |
| 4,473,430 | A | | 9/1984 | Voltmer et al. |
| 4,605,457 | A | | 8/1986 | Guy |
| 4,618,138 | A | * | 10/1986 | Silverberg ..... 271/245 |
| 4,649,691 | A | | 3/1987 | Buckholz |
| 5,191,751 | A | | 3/1993 | Marzullo et al. |
| 5,251,425 | A | | 10/1993 | Kern |
| 5,327,705 | A | | 7/1994 | DeFigueiredo |
| 5,374,044 | A | | 12/1994 | Belec et al. |
| 5,487,254 | A | | 1/1996 | Dronsfield |
| 5,660,030 | A | * | 8/1997 | Auerbach et al. ..... 53/569 |
| 5,675,959 | A | * | 10/1997 | Hamma et al. ..... 53/381.1 |
| 5,992,132 | A | | 11/1999 | Auerbach |

(Continued)

FOREIGN PATENT DOCUMENTS

| | | |
|---|---|---|
| CA | 2 373 321 | 11/2000 |
| DE | 37 00 112 | 7/1988 |

(Continued)

OTHER PUBLICATIONS

Third Office Action issued in related Chinese Patent Application No. 200380109842.0; Mar. 27, 2009; 8 pages; Chinese Patent Office.

(Continued)

*Primary Examiner* — Kavel Singh
(74) *Attorney, Agent, or Firm* — Wood, Herron & Evans, LLP

(57) ABSTRACT

Apparatus is provided for transporting a paper or film discrete object in a machine direction. A top engaging portion contacts a first side of the object and a bottom engaging portion contacts a second side of the object opposite the first side and respectively cooperates with the top engaging portion to grip and move the object in the machine direction. At least one of the top engaging portion or the bottom engaging portion includes a plurality of deflectable elements for engaging the object.

23 Claims, 4 Drawing Sheets

U.S. PATENT DOCUMENTS

| | | | | |
|---|---|---|---|---|
| 6,352,257 | B1 | 3/2002 | Todaro et al. | |
| 6,561,502 | B1 | 5/2003 | Flickner | |
| 6,595,348 | B1 | 7/2003 | Grasswill et al. | |
| 6,773,008 | B2 * | 8/2004 | Eberle | 271/205 |
| 2006/0156876 | A1 | 7/2006 | Sussmeier et al. | |
| 2006/0249895 | A1 | 11/2006 | Kern | |
| 2007/0040316 | A1 | 2/2007 | Kern | |
| 2008/0087147 | A1 | 4/2008 | Sussmeier et al. | |
| 2008/0106022 | A1 | 5/2008 | Sussmeier et al. | |

FOREIGN PATENT DOCUMENTS

| | | |
|---|---|---|
| DE | 198 02 085 | 7/1999 |
| EP | 0 504 114 | 9/1992 |
| EP | 0 876 908 | 11/1998 |
| EP | 1 297 970 | 4/2003 |
| EP | 1 622 778 | 11/2004 |
| EP | 1 541 511 | 6/2005 |
| EP | 1 683 651 | 7/2006 |
| WO | 03/016187 | 2/2003 |
| WO | 2004/098905 | 11/2004 |

OTHER PUBLICATIONS

Irina Becker; Invitation to Pay Additional Fees in related PCT patent application No. PCT/US2009/030538; Apr. 1, 2009; 5 pages; European Patent Office.

Irina Becker; Invitation to Pay Additional Fees in related PCT patent application No. PCT/US2009/030549; Apr. 8, 2009; 5 pages; European Patent Office.

Ole Henningsen; International Search Report and Written Opinion issued in related PCT Application No. PCT/US2009/030571; Jun. 2, 2009; 12 pages; European Patent Office.

* cited by examiner

TRANSPORTING APPARATUS FOR WEB PRODUCTS AND RELATED METHODS

CROSS-REFERENCE

This application is generally related to the following co-pending U.S. patent applications: Ser. No. 12/231,739 , entitled "Apparatus for Guiding and Cutting Web Products and Related Methods;" Ser. No. 12/231,755, entitled "Envelope Conveying and Positioning Apparatus and Related Methods;" Ser. No. 12/231,753, entitled "Inserting Apparatus for Discrete Objects into Envelopes and Related Methods;" Ser. No. 12/231,754, entitled "Transporting Apparatus for Discrete Sheets into Envelopes and Related Methods;" and Ser. No. 12/231,730, entitled "Conveying Apparatus for Envelopes and Related Methods", all being filed on even date herewith and expressly incorporated herein by reference in their entirety.

TECHNICAL FIELD

The present invention generally relates to converting equipment and, more particularly, to apparatus for converting paper into sheets, collating and automatic envelope stuffing operations.

BACKGROUND

Converting equipment is known for automatically stuffing envelopes. Such equipment may include components for feeding a pre-printed web of paper, for cutting such web into one or more discrete sheets for collating sheets, and for feeding such discrete sheet collations into envelopes. Such equipment may further include components to convey the stuffed envelopes to a specified location. The industry has long known devices which accomplish these and other functions. However, improvements are needed where high volumes of paper piece count and high speeds are required without sacrificing reliability accuracy and quality of end product.

More particularly, a large roll of paper is typically printed in discrete areas with piece specific information. That is, the initial roll of paper comprises vast numbers of discrete areas of already-printed indicia-specific information with each discrete area defining what is to eventually comprise a single page or sheet of indicia specific information. To complicate the process, a variable number of sheets with related indicia must be placed into the envelopes so that the content of one envelope varies from the content of another by sheet count and, of course, by the specific indicia on the included sheets. As one example, financial reports of multiple customers or account specifics may require a varied number of customer or account specific sheets to be cut, respectively collated, stuffed and discharged for delivery. Thus, the contents of each envelope include either a single sheet or a "collation" of from two to many sheets, each "collation" being specific to a mailing to an addressee.

In such an exemplary operation, a financial institution might send billing or invoice information to each of its customers. The billing information or "indicia" for one customer may require anywhere from one final sheet to a number of sheets which must be collated, then placed in that customer's envelope. While all this information can be printed in sheet size discrete areas, on a single roll, these areas must be well defined, cut, merged or collated into sheets for the same addressee or destination, placed into envelopes, treated and discharged. Thus, a system for conducting this process has in the past included certain typical components, such as a paper roll stand, drive, sheet cutter, merge unit, accumulate or collate unit, folder, envelope feeder, envelope inserter, and finishing and discharge units. Electronic controls are used to operate the system to correlate the functions so correct sheets are collated and placed in correct destination envelopes.

In such multi-component systems, the pass-through rate from paper roll to finished envelope is dependent on the speed of each component, and overall production speed is a function of the slowest or weakest link component. Overall reliability is similarly limited. Moreover, the mean down time from any malfunction or failure to repair is limited by the most repair-prone, most maintenance consumptive component. Such systems are capital intensive, requiring significant floor plan or footprint, and require significant labor, materials and maintenance capabilities and facilities.

In such a system, it is sometimes necessary to transport a single discrete sheet of material or two side-by-side discrete sheets of material, for example, between a cutting apparatus and a buffering and folding station. Conventional systems may tend to damage the sheets of material or be subject to poor performance due to excessive wear and tear of solid structures used to engage the sheets.

Accordingly, it is desirable to provide improved paper transporting apparatus in a high speed handling machine. It is also desirable to provide a transporting system and related methods that address inherent problems observed with conventional paper systems.

SUMMARY

To these ends, in one particular embodiment of the invention an apparatus is provided for transporting a paper or film discrete object in a machine direction. The apparatus includes a top engaging portion for contacting a first side of the object and a bottom engaging portion for contacting a second side of the object opposite the first side and respectively cooperating with the top engaging portion to move the object in the machine direction. At least one of the top engaging portion or the bottom engaging portion includes a plurality of deflectable elements for engaging the object. The deflectable elements may, for example, be in the form of bristles. One of the top or bottom engaging portions may include the plurality of deflectable elements while the other of the top or bottom engaging portions includes a rubber belt for engaging the object. The apparatus may include a driving mechanism that is operatively coupled to at least one of the top or bottom engaging portions for moving the object in the machine direction. The drive mechanism may be configured to drive the top and bottom engaging portions at substantially equal surface speeds. The driving mechanism may additionally or alternatively be a servo device. The deflectable elements may be arranged to deflect and thereby accommodate a thickness of the object. The bottom engaging portion may include a pair of opposed belt assemblies, with the apparatus including a support surface disposed between the opposed belt assemblies for supporting a center portion of the object.

The top and bottom engaging portions may be configured to move two side-by-side paper or film objects in the machine direction, with the support surface being configured to support inner edges of each of the objects. At least one roller may be disposed for contacting the object and cooperates with at least one of the top engaging portion or the bottom engaging portion to guide the object in the machine direction. The top engaging portion may include a first pair of opposed belt assemblies and the bottom engaging portion may include a second pair of opposed belt assemblies respectively cooperating with the first pair of belt assemblies for engaging the object. The belt assemblies of at least the first pair or the second pair are non-parallel relative to one another. The belt assemblies of at least the first pair or the second pair may diverge in the machine direction.

In another embodiment, an apparatus is provided for transporting a pair of discrete side-by-side paper or film objects in a machine direction. The apparatus includes a top engaging portion including a first pair of opposed belt assemblies for contacting respective first sides of each of the objects and respective lateral edges of each of the objects, and a bottom engaging portion. The bottom engaging portion includes a second pair of opposed belt assemblies that respectively cooperate with the first pair of belt assemblies for contacting the second sides of each of the objects opposite the first sides and respectively cooperates with the top engaging portion to move the objects in the machine direction. One of the top engaging portion or the bottom engaging portion includes a plurality of bristles for engaging the objects, and the belt assemblies of at least the first pair or the second pair are non-parallel relative to one another. The other of the top engaging portion or the bottom engaging portion may include a rubber belt for engaging the objects.

In yet another embodiment, an automatic envelope stuffing machine is provided and includes a first end associated with feeding of a roll of paper in a machine direction. The portion of the machine is configured to process the roll of paper into discrete paper objects. A second end is associated with feeding of envelopes toward the discrete paper objects. The machine includes a transporting apparatus that includes a top engaging portion for contacting a first side of the objects and a bottom engaging portion for contacting a second side of the objects opposite the first sides and respectively cooperating with the top engaging portion to move the objects toward the second end. At least one of the top engaging portion or the bottom engaging portion includes a plurality of deflectable elements for engaging the objects.

In another embodiment, a method is provided for transporting a paper or film discrete object in a machine direction. A first side of the object is engaged with a substantially solid surface. A second side of the object opposite the first side is engaged with a substantially resilient surface that is deflectable upon engagement thereof with the object. The substantially solid surface and the substantially resilient surface are moved to thereby move the object in the machine direction. The method may include moving the substantially solid surface and the substantially resilient surface at substantially equal surface speeds. A center portion of the object may be contacted with a support surface to thereby support the object as it travels in the machine direction, and the object moved in the machine direction relative to the support surface. The method may alternatively include engaging a pair of side-by-side paper or film objects with the substantially solid surface and the substantially resilient surface to thereby move the pair of objects in the machine direction. The method may additionally or alternatively include moving the objects outwardly relative to one another in the machine direction. The method may include engaging the objects at lateral edges of the objects.

Such apparatus and methods are particularly useful in a paper converting and envelope stuffing system contemplating improved paper converting and sheet inserting apparatus and methods, modular based, and having improved paper handling apparatus, servo driven components, improved sensor density and improved control concepts controlling the system operation. One or more of the embodiments of the invention contemplate the provision of an improved transporting apparatus which can be used as a module of a modular paper converting and sheet insertion system where human capital, required space, required equipment, maintenance, labor and materials and facilities therefore are reduced compared to conventional systems of similar throughput.

More specifically, such improved apparatus and methods contemplate a plurality of functional modules providing the following functions in a series of modules of like or dissimilar modules where a specific module is multi-functional. The functions comprise:

printed paper roll handling/unwinding;
paper slitting and cutting;
sheet collation and accumulation;
sheet folding;
transportation for interfacing with inserts;
envelope feeding;
collation interfacing and insertion; and
envelope treating and discharge.

More particularly, one or more aspects of the invention may contemplate, without limitation, new and unique apparatus and methods for:

(a) guiding a web of the paper or film containing the printed indicia into a cutter apparatus;
(b) processing the web through slitting and transverse-cutting operation;
(c) transporting and merging discrete pieces of the insert;
(d) accumulating predefined stacks of discrete pieces of the insert;
(e) guiding and transporting a stack of discrete pieces of the insert toward an envelope-filling station;
(f) transporting individual envelopes toward the envelope-filling station;
(g) creating and processing a stack of the envelopes prior to the envelope-filling process; and
(h) processing an individual envelope from the stack of envelopes and through the envelope-filling station.

While the combination of the particular functions in the particular modules are unique combinations, the invention of this application lies primarily in the paper transporting apparatus and methods described herein.

DETAILED DESCRIPTION

Figure 1:
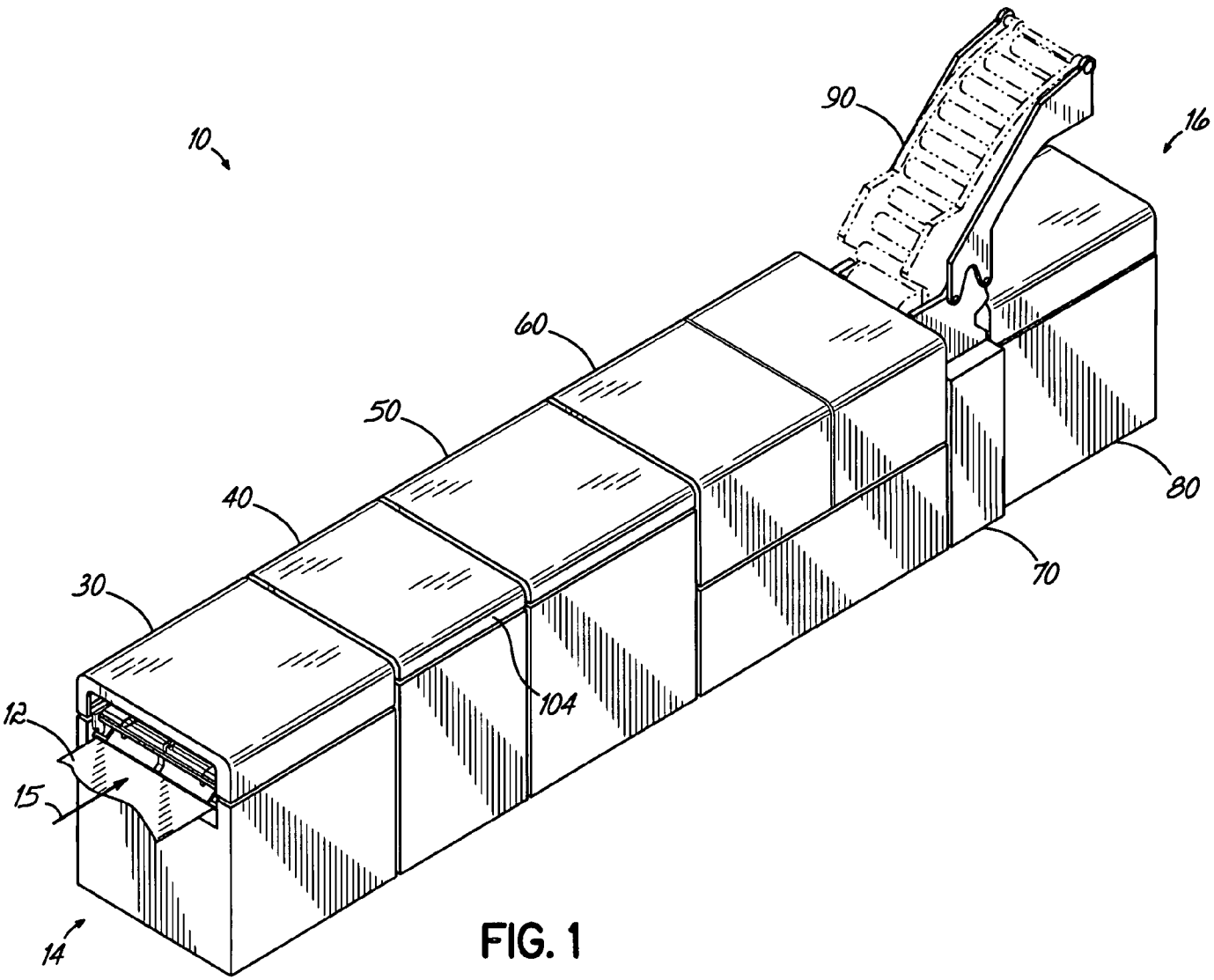
FIG. 1 is a perspective view illustrating a portion of a converter for stuffing envelopes with selected paper or film objects.

Referring to the figures and, more particularly to FIG. 1, a portion of an exemplary converter 10 is illustrated for processing a web 12 of paper or film. Although not shown, the web 12 processed by the converter 10 originates, for example, from a roll (not shown) of material containing such web. The roll is generally associated with a first end 14 of the converter 10 and is unwound in ways known in the art, for example, by driving a spindle receiving a core of the roll or by contacting a surface of the roll with a belt or similar device. Typically, the web 12 is pre-printed with indicia in discrete areas.

The web 12 thus travels in a machine direction, generally indicated by arrow 15, through several modules that make up the converter 10. In the exemplary embodiment of FIG. 1, converter 10 cuts the web material into discrete sheets (corresponding to the "areas") of material ("inserts") and feeds them into envelopes fed generally from an opposite end 16 of converter 10. Converter 10 may further convey the envelopes containing the inserts away from the shown portion of the converter 10 for subsequent processing or disposition. The exemplary converter 10 includes, as noted above, several modules for effecting different steps in the processing of the web and the inserts resulting therefrom, as well as processing of the envelopes. Those of ordinary skill in the art will readily appreciate that converter 10 may include other modules in addition or instead of those shown herein.

A first of the shown modules, for example, is a cutting module 30 relatively proximate first end 14 of the converter 10 and which cuts the web 12 into discrete objects such as inserts (not shown) for subsequent processing. A conveying module 40 controls and transports the discrete inserts received from the cutting module and feeds them into a folding and buffering module 50. Module 50 may, if necessary, form stacks of the discrete inserts for subsequent processing, for example, if the intended production requires stuffing the envelopes with inserts defined by more than one discrete sheet. Module 50 folds the discrete inserts, if required by the intended production, along a longitudinal axis of the discrete inserts disposed generally along the machine direction. Moreover, module 50 accumulates, collates or buffers sets of the discrete sheets into individually handled stacks, if the particular production so requires.

With continued reference to FIG. 1, an uptake module 60 takes the inserts from folding and buffering module 50 and cooperates with components of a stuffing module 70 to transport the inserts and feed them into envelopes. The envelopes, in turn, are handled and fed toward the stuffing module 70 by an envelope conveyor 80. A conveying assembly 90 is operatively coupled to the stuffing module 70 and the envelope conveyor 80 for conveying the stuffed or filled envelopes away from the shown portion of converter 10 for subsequent processing or disposition.

Figure 2:
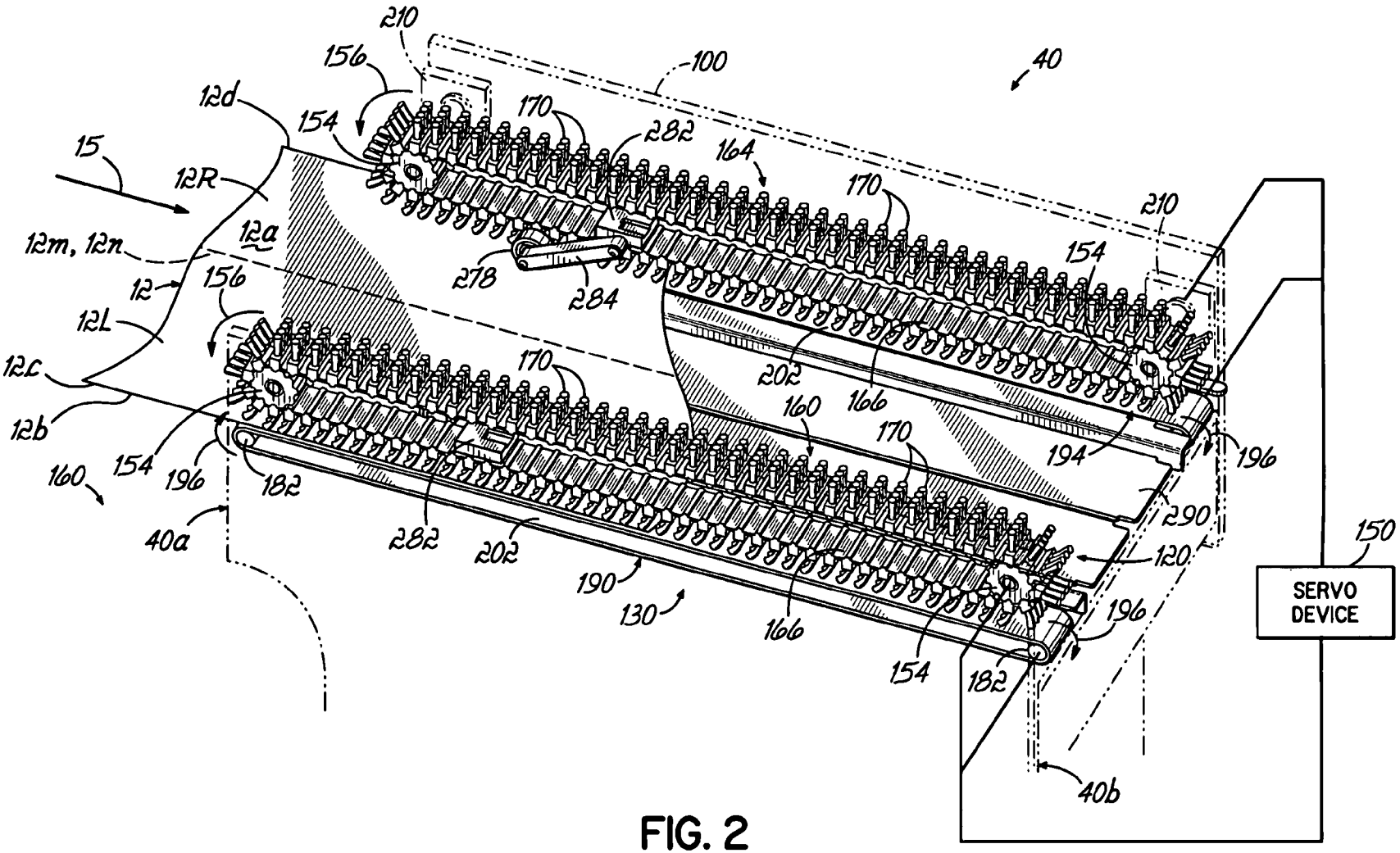
FIG. 2 is a perspective view of a transporting module of the converter of FIG. 1.
Figure 3A:
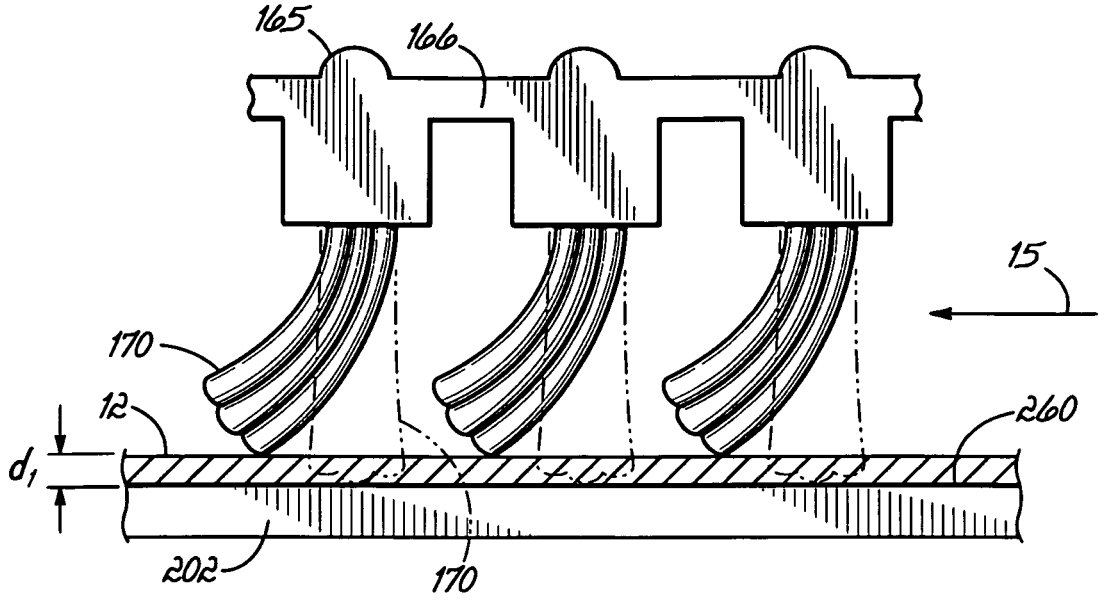
FIG. 3A is an elevation view of a plurality of bristles of the transporting module of FIG. 2.
Figure 3B:
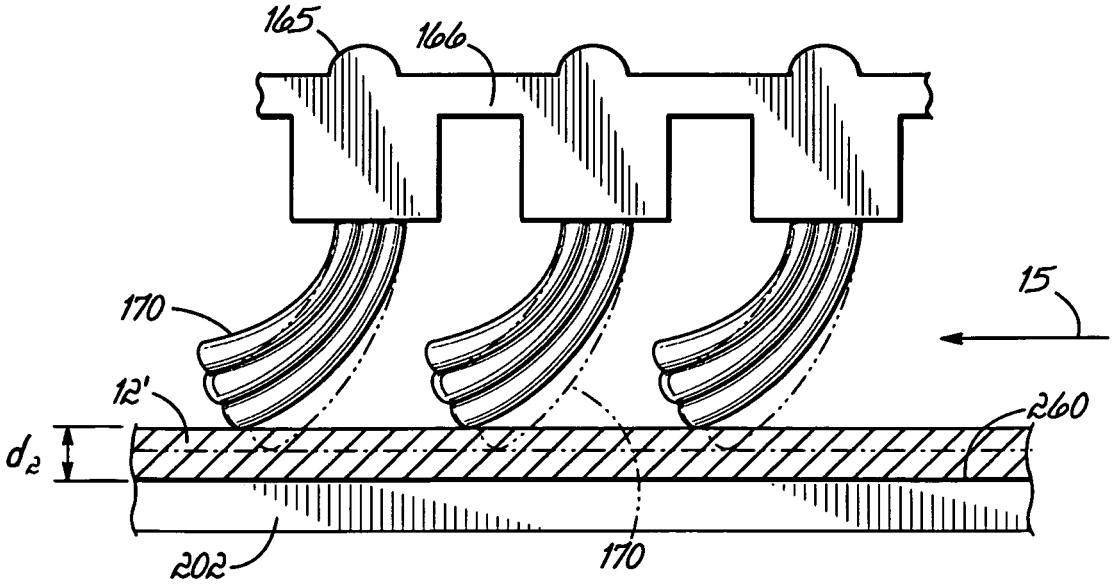
FIG. 3B is an elevation view similar to FIG. 3A showing the bristles in an orientation different from that shown in FIG. 3A.

With reference to FIGS. 2 and 3A-3B, an exemplary transporting module 40 is illustrated in greater detail. Module 40 includes a support frame or housing 100 (shown in phantom) that supports the different components of the module to be described in more detail below. Support frame 100 is in this embodiment made out of metal although other suitable materials may be chosen instead. A hood or cover 104 (FIG. 1) restricts access to moving components of module 40 and may, for example, further protect the web 12 from debris and the like. Hood or cover 104 may be made, for example, of a transparent or translucent material to permit viewing of the web and the moving components during operation.

Transporting module 40 includes a top engaging portion 120 and a bottom engaging portion 130 for respectively engaging a first (e.g., top) side 12*a* of the web and a second (e.g., bottom) side 12*b* of the web 12. As used herein, and in the context of the transportation module 40, the term "web" generally refers to a discrete paper or film object or a pair of paper or film objects arranged side-by-side. The top engaging portion 120 and the bottom engaging portion 130 cooperate with one another to move the web 12 from a first end 40*a* of the module 40 to a second end 40*b* of the module 40 in the machine direction (arrow 15). In this regard, a schematically depicted driving mechanism, for example, in the form of a servo device 150 is operatively coupled to one or both of the top and bottom engaging portions 120, 130 to cause movement thereof and thereby move the web 12 in the machine direction.

More specifically, in this exemplary embodiment, the servo device 150 is operatively coupled to a first pair of gears or sprockets 154 proximate second end 40*b* and that are in positive driving engagement with a pair of belt assemblies 160, 164 of top engaging portion 120. While not shown, in this embodiment, servo device 150 drives a common shaft that is coupled, through drive belts or pulleys, to each of the two sprockets 154 of top engaging portion 120. Positive driving engagement with belt assemblies 160, 164 is facilitated, in this embodiment, by protruding portions 165 (FIG. 3A) of belts 166 that engage the spaces between teeth or sprockets 154. Rotation of sprockets 154, for example, in the direction of arrows 156, causes movement in the machine direction of a plurality of deflectable elements in the exemplary form of bristles 170 extending from belts 166 that are in positive driving engagement with sprockets 154. While not shown in this exemplary embodiment, it is contemplated that servo device 150 may be additionally or alternatively operatively coupled to only one of the sprockets 154 proximate second end 40*b* of module 40 or to one or both of a second pair of sprockets 154 located proximate the first end 40*a* of module 40. It is also contemplated that either or both of the top and bottom engaging portions 120, 130 may have a single belt assembly, rather than the exemplary respective pairs of belt assemblies of this embodiment. As used herein, the term "deflectable" as applicable to the deflectable elements of this embodiment and alternative embodiments refers to solid or semi-solid structures that bend or deform upon the action of a force.

With particular reference to FIG. 2, in this exemplary embodiment servo device 150 is also operatively coupled to a pair of rollers 182 located proximate second end 40*b* of module 40 and that are in positive driving engagement with a second pair of belt assemblies 190, 194 of bottom engaging portion 130. Rotation of rollers 182, for example, in the direction of arrows 196, causes movement, in the machine direction, of a pair of belts 202 that are in positive driving engagement with rollers 182. While not shown in this exemplary embodiment, it is contemplated that servo device 150 may be additionally or alternatively operatively coupled to only one of the rollers 182 proximate second end 40*b* of module 40 or to one or both of a second pair of rollers 182 located proximate the first end 40*a* of module 40.

Driving of top and bottom engaging portions 120, 130 is facilitated, in this embodiment, by bearing assemblies 210 providing coupling between support frame 100 and sprockets 154 and may be further facilitated by bearing assemblies (not shown) or other types of coupling between rollers 182 of the bottom engaging portion 130 and support frame 100. As used herein, the terms "top," "bottom," "upward," "downward" and respective derivatives thereof are not intended to be limiting but rather reflect the exemplary orientations shown in the figures.

As noted above, top engaging portion 120 includes bristles 170 extending from belts 166. Some or all of bristles 170 can be formed, for example, from nylon or other suitably chosen material(s). Bristles 170 permit gentle engagement of web 12. More specifically, in this embodiment, bristles 170 are arranged in four rows of groups of bristles 170, with the groups being spaced in the machine direction. This type of arrangement, although merely illustrative and therefore not intended to be limiting, results in the application of a relatively small force by each individual bristle 172 against the web 12. Moreover, the material from which bristles 170 are formed, as well as their arrangement, permit them to deflect in response to engaging contact with the web 12. In this regard, therefore, bristles 170 deflect in accordance with the thickness of web 12, thereby permitting handling, by module 40, of webs 12 of different thickness.

With particular reference to FIGS. 3A and 3B, the above described deflection of bristles 170 is exemplarily depicted. More particularly, FIG. 3A shows the bristles 170 in a first position accommodating a web 12 having a first thickness $d_1$. Deflection of bristles 170, in this regard, is relative to an orientation, shown in phantom in FIG. 3A, associated with the absence of a web 12 engaging the bristles 170. FIG. 3B shows bristles 170 in a different orientation, having deflected to a greater extent to accommodate a web 12' having a greater thickness $d_2$ relative to that of web 12 (FIG. 3A). More specifically, FIG. 3B shows bristles 170 having deflected to a greater extent relative to the deflection (shown in phantom in FIG. 3B) caused by web 12 (FIG. 3A). This deflectable feature of bristles 170 similarly provides for any upward motion of web 12 that may occur during travel of web 12 in the machine direction.

With continued reference to FIGS. 2 and 3A-3B, the bottom engaging portion 130 includes a belt surface 260 of belts 202 that cooperate with bristles 170 to engage and move web 12 in the machine direction. More specifically, belt surface 260 is generally flat and provides a substantially solid supporting surface against which bristles 170 deflect as described above. Moreover, belt surface 260 is configured to provide sufficient engagement so as to prevent or minimize slippage of web 12 relative to the belt surface 260. For example, and without limitation, the belts 202 may be formed from rubber such that belt surface 260 applies, when engaged, a relatively high level of friction against web 12. Alternatively, belts 202 may be made of any material so long as belt surface 260 is configured to engage and move web 12 in the machine direction. For example, the belt surface 260 may designed with a texture or be in the form of a coating applied onto belts 202.

As discussed above, the exemplary embodiment of FIGS. 2, 3A-3B includes a servo device 150 operatively coupled to one or both of the top or bottom engaging portions 120, 130 for moving the web 12 in the machine direction. Servo device 150 may be configured to drive the top and bottom engaging portions 120, 130 at surface speeds that are substantially equal to one another. For example, servo device 150 may be configured such that the speed of movement of belts 166 is different from that of belts 202, thereby accounting for the amount of deflection of bristles 170. More particularly, in this embodiment, the surface speed of top engaging portion 120 is defined by the speed at the points where bristles 170 engage the web 12, rather than at belts 166. Accordingly, rotation of sprockets 154 results in a surface speed (i.e., the speed at the point of contact of bristles 170 with web 12) that is greater than the speed of movement of the belts 166. In this regard, therefore, servo device 150 may be configured to provide for this difference such that the resulting surface speed of the top engaging portion 120 is substantially equal to that of the belt surface 260 of bottom engaging portion 130.

Travel of the web 12 in the machine direction is further facilitated, in this exemplary embodiment, by one or more guiding rollers 278 (only one shown) disposed in a region proximate the first end 40*a* of module 40*b* that help guide the web 12 within module 40. More particularly, the rollers 278 are pivotally mounted to support frame 100 via a mounting block 282 and a pivot arm 284 as shown in FIG. 2. Rollers 278 prevent erratic upward or downward movement of web 12 during travel in the machine direction. Rollers 278 apply a downward pressure against web 12, and more particularly, against the belts 202, to thereby nip and thus minimize upward movement of the web 12.

With particular reference to FIG. 2, a support surface 290, made, for example of metal, also facilitates travel of the web 12 within module 40. More particularly, support surface 290 is fixed relative to the web 12 (i.e., it does not move with the web 12) and supports a main or center portion of a web 12 in the form of a single discrete sheet. Alternatively, when module 40 is processing a web in the form of two side-by-side objects or sheets 12L, 12R, support surface 290 supports most of the body of each of the sheets 12L, 12R as well as the inner edges 12*m*, 12*n* of sheets 12L, 12R.

Figure 4:
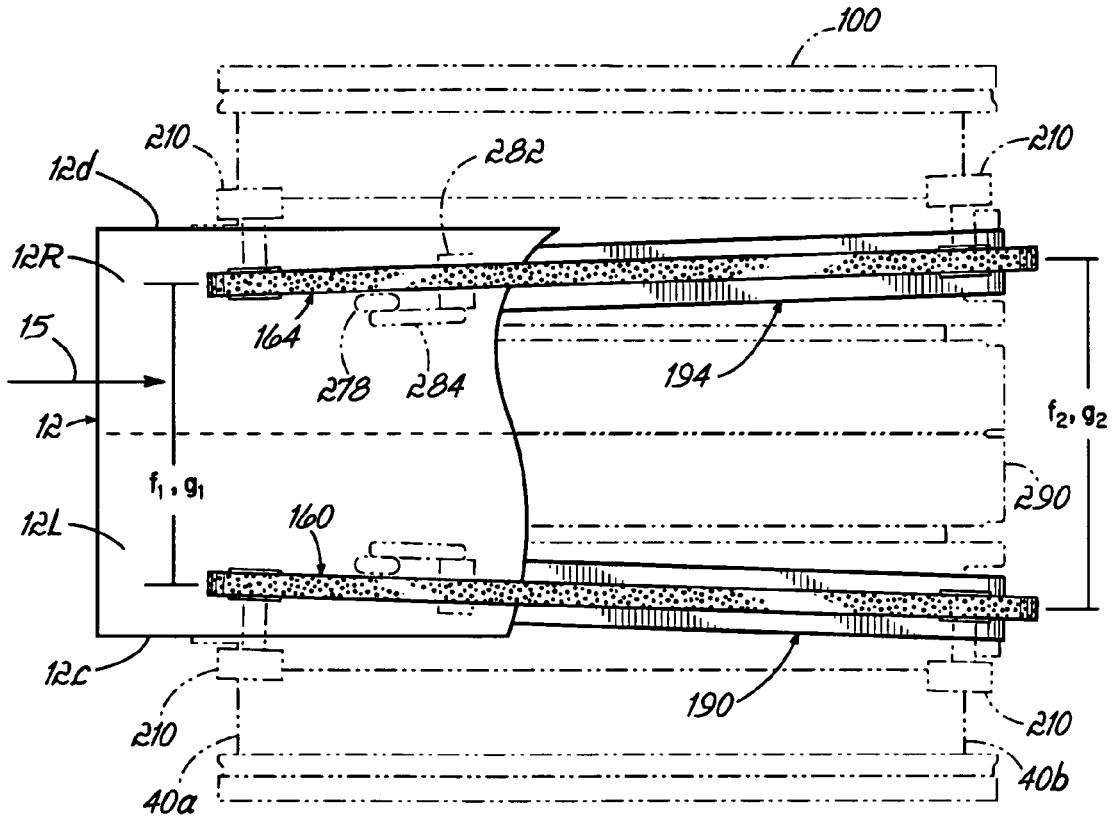
FIG. 4 is a top diagrammatic view of features of the transporting module of FIG. 2.

With reference to FIG. 4, in this exemplary embodiment, the first pair of belt assemblies 160, 164 of the top engaging portion 120, as well as the second pair of belt assemblies 190, 194 of the bottom engaging portion 130, are arranged in respective non-parallel orientations. More particularly, the belt assemblies 160, 164, 190, 194 diverge in the machine direction. Accordingly, the belt assemblies 160, 164 define a first distance $f_1$ between them proximate the first end 40*a* of module 40, and a second, greater distance $f_2$ between them proximate the second end 40*b*. Likewise, the belt assemblies 190, 194 define a first distance $g_1$ between them proximate the first end 40*a* of module 40, and a second, greater distance $g_2$ between them proximate the second end 40*b*. Those of ordinary skill in the art will readily appreciate that, alternatively, only one or none of the two pairs of belt assemblies may diverge.

In this exemplary embodiment, the diverging orientation of the belt assemblies 160, 164, 190, 194 induces a spreading (e.g. outward) force on the web 12. Accordingly, when module 40 processes a single discrete object or sheet, the top and bottom engaging portions 120, 130 engage the lateral edges 12*b*, 12*c* of web 12, which move the web 12 in the machine direction and further direct the edges 12*c*, 12*d* outwardly, thereby preventing or eliminating wrinkles on the web 12. Alternatively, when module 40 processes two side-by-side objects or sheets 12L, 12R (as suggested by the dashed line in the middle portion of web 12), the top and bottom engaging portions 120, 130 engage the respective outward lateral edges 12*b*, 12*c* of web 12 to move sheets 12L, 12R in the machine direction and further outwardly away from one another. This may be desirable, for example, to direct sheets 12L, 12R into different portions of the folding and buffering module 50 (FIG. 1) for subsequent processing.

While the present invention has been illustrated by a description of various embodiments and while these embodiments have been described in considerable detail, it is not intended to restrict or in any way limit the scope of the appended claims to such detail. For example, and without limitation, other alternatives structures may replace bristles 170, so long as they provide a substantially resilient surface to engage web 12 and include at least some of the functions described above. For example, and also without limitation, such structures may be in the form of flexible flaps. Likewise, the first pair of belt assemblies 160, 164 of the top engaging portion 120, and/or the second pair of belt assemblies 190, 194 of the bottom engaging portion 130 may instead be arranged in respective parallel orientations rather than in the non-parallel orientations shown and described herein. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of the general inventive concept.

What is claimed is:

1. An apparatus for transporting a paper or film discrete object having edges in a machine direction, comprising:

a top engaging conveyor portion comprising a first pair of integral continuous members for contacting a first side of the object proximate respective edges thereof and moveable in a downstream direction; and a bottom engaging conveyor portion comprising a second pair of integral continuous members for contacting a second side of the object opposite the first side and respectively opposed to respective ones of said first pair of integral continuous members, said bottom engaging conveyor portion moveable in said downstream direction, and respectively cooperating with said top engaging conveyor portion to move the object in the downstream direction;

wherein the members of one of said top or bottom engaging conveyor portions include a plurality of deflectable elements extending therefrom for engaging the object on one side thereof and mounted for deflecting in response to such direct engaging and wherein the other said top or bottom engaging conveyor portions includes a substantially solid conveying surface for contacting the object on another side thereof, opposite said deflectable elements.

2. The apparatus of claim 1, wherein said substantially solid conveying surface for contacting the object includes a rubber belt.

3. The apparatus of claim 1, further comprising:

a driving mechanism operatively coupled to at least one of said top or bottom engaging conveyor portions for moving the object in the machine direction.

4. The apparatus of claim 3, wherein said driving mechanism is configured to drive said top and bottom engaging conveyor portions at substantially equal surface speeds.

5. The apparatus of claim 1, wherein said driving mechanism is a servo device.

6. The apparatus of claim 1, wherein said deflectable elements are arranged to deflect upon directly engaging an object to accommodate a thickness of the object.

7. The apparatus of claim 1, said conveyors further comprising:

a support surface elongated in said machine direction and disposed between conveyors of said bottom portion for supporting a center portion of the object.

8. The apparatus of claim 7, wherein said top and bottom engaging portions are configured to move two side-by-side paper or film objects in the downstream direction, said support surface being configured to support central portions of each of the objects.

9. The apparatus of claim 1, further comprising:

at least one roller contacting the object and cooperating with at least one of said top engaging conveyor portion or said bottom engaging conveyor portion to guide the object in the downstream direction.

10. The apparatus of claim 1, wherein said top engaging conveyor portion includes a first pair of opposed belt assemblies and said bottom engaging conveyor portion includes a second pair of opposed belt assemblies respectively cooperating with said first pair of belt assemblies for engaging the object, said belt assemblies of at least said first pair or said second pair being non-parallel relative to one another.

11. The apparatus of claim 10, wherein said belt assemblies of at least said first pair or said second pair diverge from the machine direction.

12. The apparatus of claim 1, wherein said plurality of deflectable elements are in the form of bristles.

13. The apparatus of claim 1, wherein said plurality of deflectable elements are formed from nylon.

14. The apparatus of claim 1, wherein said plurality of bristles comprise a material different from that top or bottom portions from which they extend.

15. An apparatus for transporting a pair of discrete side-by-side paper or film objects in a machine direction, comprising:

a top engaging portion moveable in a downstream direction and including a first pair of opposed belt assemblies for contacting respective first sides of each of the objects at respective opposite lateral edges of each of the objects; and a bottom engaging portion moveable in a downstream direction, including a second pair of opposed belt assemblies for contacting second side of each of the objects opposite the first sides, and respectively cooperating with and opposite to said top engaging portion to move the objects in the machine direction; wherein:

one of said top engaging portion or said bottom engaging portion includes a plurality of bristles extending therefrom for engaging the objects; and said belt assemblies of at least said first pair or said second pair are non-parallel to one another.

16. The apparatus of claim 15, wherein said belt assemblies of at least said first pair or said second pair diverge from the machine direction.

17. The apparatus of claim 15, wherein the other of said top engaging portion or said bottom engaging portion includes a rubber belt for engaging the objects.

18. A method of transporting a paper or film discrete object in a machine direction, comprising:

contacting a first side of the object with a moveable substantially solid surface;

contacting a second side of the object opposite the first side with a moveable substantially resilient surface deflectable upon engagement thereof with the object; and moving the substantially solid surface and the substantially resilient surface to thereby move the object in the machine direction, and moving the substantially solid surface and the substantially resilient surface at substantially equal surface speeds.

19. The method of claim 18, further comprising:

moving the substantially solid surface and the substantially resilient surface at substantially equal surface speeds.

20. The method of claim 18, further comprising:

contacting a center portion of the object with a fixed support surface to thereby support the object as it travels in the machine direction; and moving the object in the machine direction relative to the support surface.

21. The method of claim 18, further comprising:

engaging a pair of side-by-side paper or film objects with the moveable substantially solid surface and the substantially resilient surface to thereby move the pair of objects in the machine direction.

22. The method of claim 21, further comprising:

moving the objects outwardly relative to one another with respect to the machine direction.

23. The method of claim 18, further comprising:

contacting the first side of the object at opposed lateral edges of the object.

* * * * *